US006843317B2

(12) United States Patent
Mackenzie

(10) Patent No.: US 6,843,317 B2
(45) Date of Patent: Jan. 18, 2005

(54) SYSTEM AND METHOD FOR AUTONOMOUSLY PERFORMING A DOWNHOLE WELL OPERATION

(75) Inventor: Gordon R. J. Mackenzie, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 39 days.

(21) Appl. No.: 10/342,725

(22) Filed: Jan. 15, 2003

(65) Prior Publication Data

US 2003/0141078 A1 Jul. 31, 2003

Related U.S. Application Data

(60) Provisional application No. 60/350,554, filed on Jan. 22, 2002.

(51) Int. Cl.[7] ..... E21B 47/00

(52) U.S. Cl. ..... 166/254.2; 166/254.1; 166/255.1; 166/255.2; 166/53

(58) Field of Search ..... 166/254.1, 254.2, 166/255.1, 255.2, 53; 340/854.1, 854

(56) References Cited

U.S. PATENT DOCUMENTS

| | | | | |
|---|---|---|---|---|
| 5,412,568 A | | 5/1995 | Schultz | |
| 5,724,308 A | | 3/1998 | Sorrells et al. | |
| 5,947,213 A | * | 9/1999 | Angle et al. | 175/24 |
| 6,061,633 A | | 5/2000 | Fukuhara et al. | |
| 6,182,765 B1 | | 2/2001 | Kilgore | |
| 6,273,189 B1 | | 8/2001 | Gissler et al. | |
| 2002/0104653 A1 | * | 8/2002 | Hosie et al. | 166/254.2 |

FOREIGN PATENT DOCUMENTS

| | | |
|---|---|---|
| WO | WO 98/02634 | 1/1998 |
| WO | WO 98/12418 | 3/1998 |

* cited by examiner

*Primary Examiner*—David Bagnell
*Assistant Examiner*—Giovanna M. Collins
(74) *Attorney, Agent, or Firm*—Madan, Mossman & Sriram, P.C.

(57) ABSTRACT

An autonomous system for performing a well operation at a predetermined location in a wellbore comprises a tool string having at least one well tool, a motive device for traversing the wellbore, and a control system adapted to position the tool string near the predetermined location. The control system comprises (i) a sensing system for detecting mass irregularities in the wellbore and (ii) a processor system having a processor with memory for storing at least one well log. The processor acts under programmed instructions to compare sensor signals to the stored well log to determine a tool string position in the wellbore. The control system also contains circuits for controlling the operation of the well tool and the motive device.

13 Claims, 2 Drawing Sheets

SYSTEM AND METHOD FOR AUTONOMOUSLY PERFORMING A DOWNHOLE WELL OPERATION

This application claims the benefit of Provisional Application No. 60/350,554, filed Jan. 22, 2002.

BACKGROUND OF THE INVENTION

1. Field of the Invention

The present invention relates generally to subterranean well completion, servicing, and rework and more particularly to an autonomous system for operating a well tool in a wellbore for purposes of completion, servicing, and rework.

2. Description of the Related Art

In the drilling and completion of oil and gas wells, a wellbore is drilled into a subsurface producing formation. Typically, a string of casing pipe is then cemented into the wellbore. An additional string of pipe, commonly known as production tubing, may be disposed within the casing string and is used to conduct production fluids out of the wellbore. The downhole string of casing pipe is comprised of a plurality of pipe sections which are threadedly joined together. The pipe joints, also referred to as collars, have increased mass as compared to the pipe sections. After the strings of pipe have been cemented into the well, logging tools are run to determine the location of the casing collars. The logging tools used include a pipe joint locator whereby the depths of each of the pipe joints through which the logging tools are passed is recorded. The logging tools generally also include a gamma ray logging device which records the depths and the levels of naturally occurring gamma rays that are emitted from various well formations. The casing collar and gamma ray logs are correlated with previous open hole logs which results in a very accurate record of the depths of the pipe joints across the subterranean zones of interest and is typically referred to as the joint and tally log. After additional downhole completion hardware is installed, such as packers or screens, additional joint and tally logs may be run to locate these downhole elements for future reference.

Although modern oil and gas well production has progressed to a fine art, a variety of difficult problems may still be encountered during well completion, production, servicing and rework and it is often necessary to precisely locate one or more of the casing pipe joints or other downhole elements in a well. Of necessity, these situations must be remedied from the well platform for offshore wells or from the wellhead for land wells. Each well presents a unique challenge depending upon the well type, i.e., oil or gas, and the action to be taken. Typical problems requiring correction within a well are: crushed regions in the tubing, sand bridges or accumulation of paraffin, scale, rust or other debris. Maintenance procedures that must also be accomplished from the surface include, but are not limited to, the need to set or remove lock mandrels, bridge plugs, collar stops or safety valves. Specific, commercially-available tools have been developed for each of these maintenance actions or problem solutions.

To perform these remedial operations the well tool is deployed into the wellbore using a variety of methods. The tool may be deployed on wireline or tubing. The term tubing refers to either coiled or jointed tubing. The tool may, alternatively, be pumped down. The depth of a particular casing pipe joint adjacent or near the desired location at which the tool is to be positioned can readily be found on the previously recorded joint and tally log for the well.

Each of the deployment techniques mentioned require significant equipment and manpower to deploy the tool in the wellbore. In order to realize a significant cost saving in performing these remedial operations, a need exists for an autonomous system for performing the required well operations.

SUMMARY OF THE INVENTION

The present invention provides an autonomous system and methods for use for operating a well tool near a predetermined location in a wellbore that overcomes the shortcomings of the prior art.

In one embodiment of the present invention, an autonomous system is provided for operating a well tool proximate a predetermined location in a wellbore. The system comprises a tool string having at least one well tool for performing at least one well operation in the wellbore; a motive device for causing the tool string to traverse the wellbore; and a control system adapted to position the tool string proximate the predetermined borehole location. The control system contains at least one sensor for detecting mass irregularities caused by downhole production elements including but not limited to casing collars; bridge plugs; collar stops; safety valves; and packers. The sensor may also detect mass irregularities caused by perforated casing. The control system also has a processor system with a processor and a memory for storing at least one well log into the memory in the autonomous system. The control system compares the sensor signals to the well log to locate the tool proximate the predetermined downhole location. The control system also controls the operation of the motive device and the well tool.

Another preferred embodiment of the present invention is a method for autonomously performing a well operation proximate a predetermined location downhole. The method comprises storing a well log in a memory of a processor in a control system in a tool string. The tool string is traversed through the wellbore under autonomous control of the control system. At least one parameter of interest is sensed in the wellbore and a signal related thereto is generated. The sensed signal is compared to the stored well log to identify the predetermined location in the wellbore. The well tool is operated under autonomous control of the control system proximate the predetermined location.

Another aspect of the present invention is a method of autonomously performing a well operation proximate a predetermined location in a wellbore. The method comprises storing in the memory of a processor in a control system the number of mass irregularities to be traversed to reach a predetermine location in the wellbore. The tool string is traversed through the wellbore under autonomous control of the control system. The number of mass irregularities traversed in the wellbore is sensed to locate the tool proximate the predetermined wellbore location. A well tool is operated under autonomous control of the control system proximate the predetermined location.

Another method of autonomously performing a well operation proximate a predetermined location in a wellbore comprises storing in the memory of a processor in a control system a sensor signature for identifying a predetermined mass irregularity related to a predetermined location in the wellbore. The tool string is traversed through the wellbore under autonomous control of the control system. The mass irregularities traversed in the wellbore are sensed and a signal related thereto is generated. The tool is located proximate the predetermined wellbore location by identifying the predetermined mass irregularity by comparing the sensor signal to the stored signature using signal comparison techniques. The well tool is operated under autonomous control of the control system proximate the predetermined location.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1:
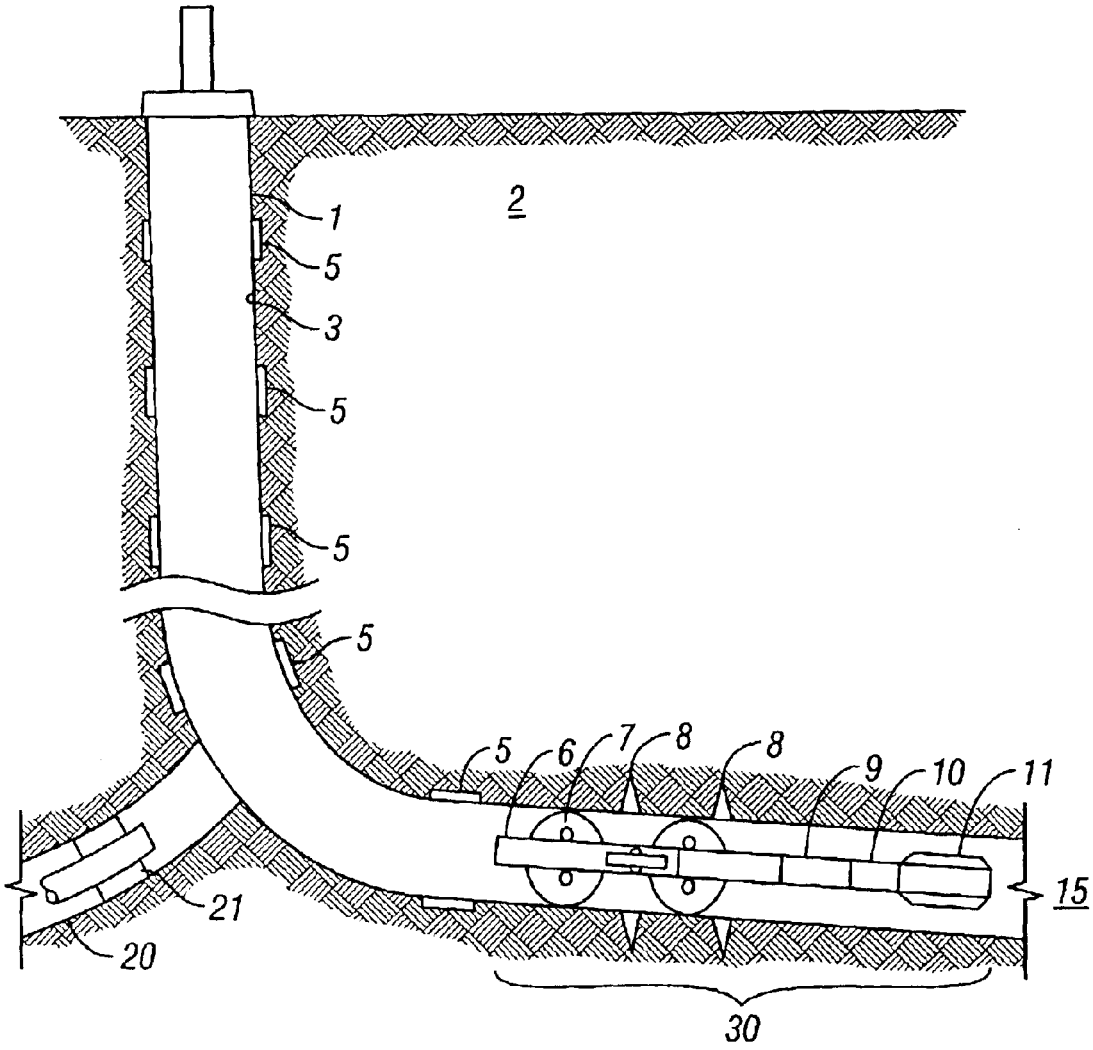
FIG. 1 is a schematic illustration of an autonomous system for performing a well operation according to one embodiment of the present invention.

In FIG. 1, according to one preferred embodiment, a wellbore 1 is schematically illustrated penetrating a subterranean formation 2. The wellbore 1 is completed with a casing string 3 in the usual manner. The casing string comprises multiple sections of pipe joined together by casing collars 5 at each joint. The wellbore 1 is shown with a deviated bottom hole section 15 which is not uncommon. However, the system described herein is also suitable for use in essentially vertical wellbores as well. Also shown in FIG. 1 is a lateral takeoff wellbore 20 which is completed with a packer 21. Such multiple takeoffs are becoming common in drilling. The casing collars 5 and other downhole equipment such as packer 21 create mass irregularities compared to the relatively uniform mass of the casing 3. Perforations 8 also create mass irregularities by removing mass from the casing. During the casing and completion of the well, these mass irregularities are logged typically using electromagnetic sensors known in the art and a signal simply indicating the presence of a mass irregularity is preserved in a joint and tally log. This log may be presented in tabular and/or graphical formats and be made available in electronic digital format. Alternatively, the sensor signal characteristics may be stored to generate a log of essentially unique signature for various types of mass irregularities. Alternatively, any other suitable sensor may be used for detecting the mass irregularities including, but not limited to acoustic sensors, ultrasonic sensors, and nuclear sensors.

Figure 2:
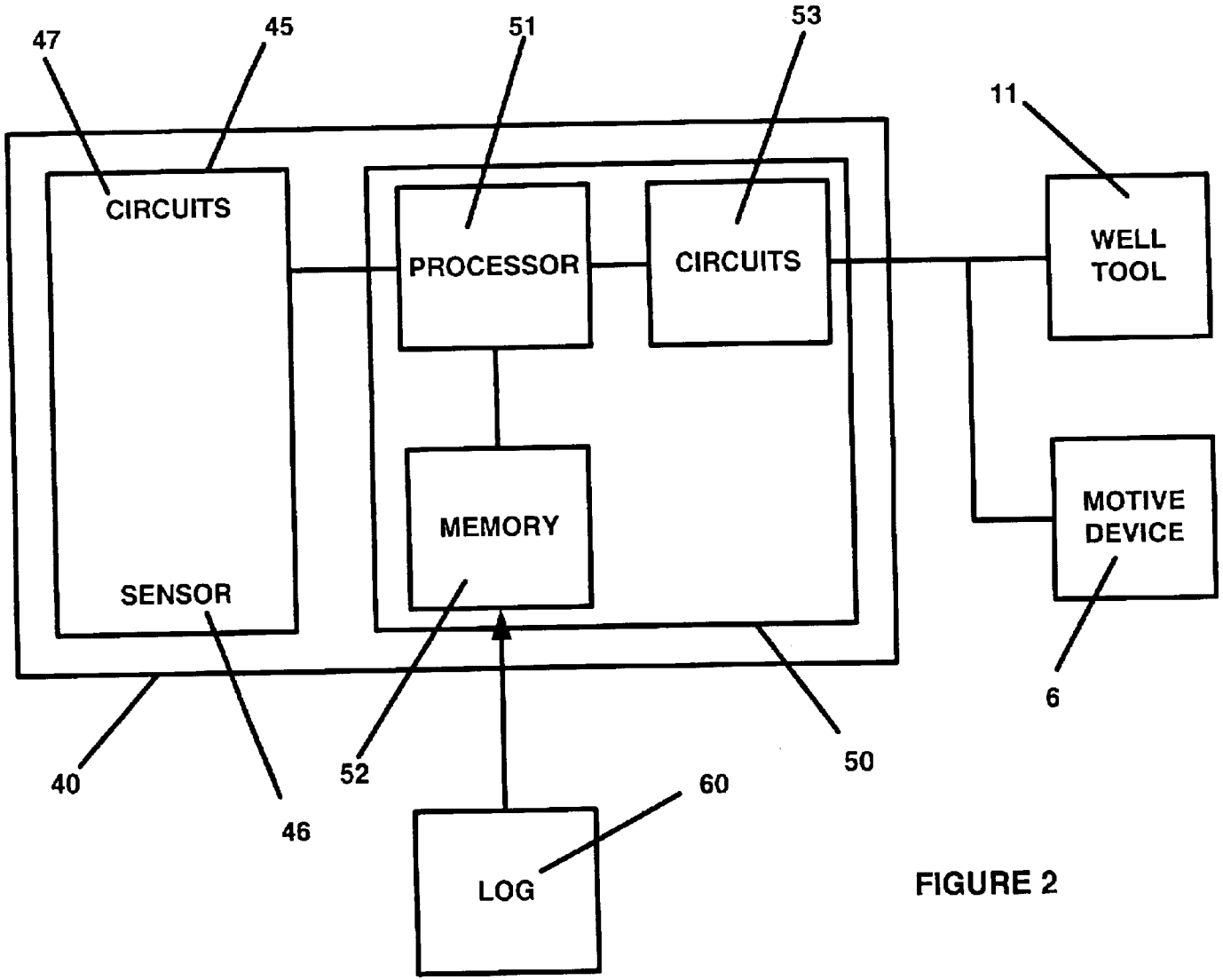
FIG. 2 is a schematic block diagram showing interaction of the control system with other components of the autonomous tool string according to one embodiment of the present invention.

Located in the bottom hole section 15 is autonomous tool string 30 (ATS). ATS 30 comprises a motive device 6 such as an exemplary downhole tractor having multiple wheel elements 7 for engaging the casing 3 and/or the uncased wellbore wall (not shown) and provides motive power to move the ATS 30 through the wellbore 1. Any suitable tractor device may be used for the purposes of this invention. For example, see U.S. Pat. No. 6,273,189 issued to Gissler, et al. Other such tractor devices are known in the art and are not discussed further. Coupled to the motive device 6 is an electronics module 9 containing a control system 40 (see FIG. 2) having circuits, sensors, and processing devices, described in more detail below, for determining the location of the ATS 30. Power module 10 is coupled to electronics module 9 and contains suitable electrical power storage for powering ATS 30. Power module 10 contains batteries (not shown) for providing electrical power to drive the motive device 6, the electronics module 9 and to actuate the well tool 11.

Well tool 11 is coupled to the power module 10 and performs a suitable operation on the well as directed by the control system 40. Typical well tools include, but are not limited to, bridge plugs, collar stops, safety valves, perforating devices, and packers. Although only one well tool 11 is shown in FIG. 1, more than one well tool 11 may be inserted in the ATS 30. The power module may contain sufficient electrical energy to actuate the well tool 11. Alternatively, the well tool 11 may be actuated by opening a flow port to a low pressure chamber in the well tool 11, under direction of control system 40, causing the downhole borehole pressure to actuate mechanisms (not shown) in the well tool 11 for performing the desired well operation. Such techniques are well known in the art and will not be discussed further. Another preferred embodiment uses an explosive charge (not shown), ignited under control of control system 40. Such a charge provides sufficient force to actuate the well tool 11.

In another preferred embodiment, a pressure-compensated, sealed hydraulic system (not shown) is located in the ATS 30 coupled to well tool 11, powered by power module 10, and acts under control of control system 40 for actuating well tool 11.

The electronics module 9 contains a control system 40 that comprises a sensing system 45 and a processing system 50. The sensing system 45 contains a sensor 46 that detects the mass irregularities as the ATS 30 traverses the wellbore 1 and generates a signal in response thereto. In one preferred embodiment, the sensing system 45 uses an electromagnetic sensor, similar to that used to detect casing collars and commonly used to generate the well and tally log, to generate a signal as each mass irregularity is traversed and the signal generated is conditioned by suitable circuits 47 and transmitted to the processing system 50. The processing system 50 contains a processor 51 and memory 52 suitable for storing program instructions, well and tally log information, and sensor data. The processing system 50 also includes suitable circuits for controlling the operation of the motive device 6 and the well tool 11. The processor 51, acting according to programmed instructions, is programmed to control the ATS 30 to traverse the wellbore 1 to a predetermined location, and then to operate the well tool 11 to perform a well operation. The processor 51 compares the sensor signal, in real-time, to the stored well and tally log data to determine the location of the ATS 30.

In one preferred embodiment, the ATS 30 processor memory 52 is downloaded with a simple count of mass irregularities between the surface and the predetermined downhole location. The ATS 30 processor 51 accumulates a count of the mass irregularities traversed and determines when the accumulated count matches the downloaded count. The control system 40 may then control the motive device 6 so as to locate the well tool 11 a predetermined distance from the last detected mass irregularity.

In another preferred embodiment, characteristic sensor signatures related to specific mass irregularities are stored in the memory 52 of the processor 51. The differences in geometries and relative masses of these downhole elements results in unique sensor signals, also called signatures, for each type of mass irregularity or element. These element signatures may be stored in the memory of the processor 51 of the ATS 30 described previously. These stored signature signals are compared to the signals generated as the ATS 30 is moved through the wellbore 1 using cross correlation or other signal comparison techniques known in the art. When a particular completion element is identified, the control system 40 acts according to programmed instructions to locate the well tool 11 a predetermined distance from the identified element and to initiate the well tool 11 to perform it's appropriate function.

In another preferred embodiment, a gamma ray sensor (not shown) and associated circuits (not shown) for detecting natural gamma rays emitted from the subterranean formations may be included in the downhole system. Typically, the hydrocarbon bearing formations show increased gamma ray emission over non-hydrocarbon bearing zones. This information is used to identify the various production zones for setting production tools. Any gamma detector known in the art may be used, including, but not limited to, scintillation detectors and geiger tube detectors. The gamma ray sensor may be incorporated in the sensing system 45 of the control system 40, or alternatively may be housed in a separate sub (not shown) and connected mechanically and electrically into the ATS 30 using techniques known in the art. Gamma ray logs are typically generated during the completion logging sequence at the same time as the tally log. This gamma ray log 60 can be entered into the memory 52 of the processor 51 for comparison to gamma ray measurements made while the ATS 30 traverses the wellbore. Cross correlation or any other signal comparison techniques known in the art may be used to compare the stored gamma ray signal to the stored log. This technique may be used in conjunction with the previous mass irregularity detection techniques. Alternatively, the gamma ray comparison technique may be used by itself in open-hole completions where there may not be sufficient mass irregularities to detect.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An autonomous downhole system for operating a well tool proximate a predetermined location in a wellbore, comprising:

a. a tool string having at least one well tool for performing a well operation in the wellbore;

b. a motive device in the tool string causing the tool string to traverse the wellbore; and c. a control system in the tool string adapted to autonomously position said tool string proximate the predetermined location in the wellbore, wherein the control system comprises:

i. a sensing system having at least one sensor for detecting at least one parameter of interest related to the wellbore and generating at least one signal in response thereto;

ii. a processor system having a processor with a memory for storing, at the surface, at least one well log therein, said processor acting according to programmed instructions to compare said at least one sensor signal to said at least one stored well log to determine a tool string position in the wellbore, said processor system having circuits adapted to control said well tool and said motive device.

2. The system of claim 1 further comprising a power module providing at least one of (i) electrical power and (ii) hydraulic power, to energize the well tool, the motive device, and the electronics system.

3. The system of claim 1 wherein the at least one sensor is chosen from (i) an electromagnetic sensor, (ii) a sonic sensor, (iii) an ultrasonic sensor, and (iv) a gamma ray sensor.

4. The system of claim 1 wherein the at least one well log is one of (i) a joint and tally log, (ii) a log of unique mass signatures, and (iii) a gamma ray log.

5. The system of claim 1 wherein the at least one parameter of interest is one of (i) the change of an electromagnetic field caused by a mass irregularity in a wellbore, and (ii) a formation gamma ray emission.

6. A method for autonomously performing a well operation at a predetermined location in a wellbore, comprising:

a. storing, at the surface, at least one well log in a memory of a processor of a control system in a tool string;

b. traversing the tool string through the wellbore under autonomous control of the control system;

c. sensing at least one parameter of interest in the wellbore and generating a signal related thereto;

d. comparing, using a signal comparison technique, said sensed signal to said at least one stored well log to identify the predetermined location in said wellbore; and e. operating a well tool under autonomous control of the control system to perform the well operation at the predetermined location in the wellbore.

7. The method of claim 6 wherein the well log is one of (i) a joint and tally log, (ii) a log of unique mass signatures, and (iii) a gamma ray log.

8. The method of claim 6 wherein the signal comparison technique is cross correlation.

9. A method for autonomously performing a well operation at a predetermined location in a wellbore, comprising:

a. storing in a memory of a processor of a control system in a tool string, at the surface, a first number of mass irregularities to be traversed to reach a predetermined wellbore location;

b. traversing the tool string through the wellbore under autonomous control of the control system;

c. using a sensor to detect a second number of mass irregularities traversed in the wellbore and generating a signal related thereto;

d. comparing said first number with said second number to locate the predetermined wellbore location; and e. operating a well tool to perform the well operation at the predetermined location in the wellbore.

10. The method of claim 9 wherein the sensor is an electromagnetic sensor.

11. A method for autonomously performing a well operation at a predetermined location in a wellbore, comprising:

a. storing in a memory of a processor of a control system in a tool string, at the surface, a sensor signature for identifying a predetermined mass irregularity related to a predetermined location in a wellbore;

b. traversing the tool string through the wellbore under autonomous control of the control system;

c. using a sensor to detect at least one mass irregularity traversed in the wellbore and generating a signal related thereto;

d. locating said tool at the predetermined location by identifying said predetermined mass irregularity by comparing said sensor signal to said stored signature using a signal comparison technique; and e. operating a well tool to perform the well operation at the predetermined location in the wellbore.

12. The method of claim 11 wherein the sensor is an electromagnetic sensor.

13. The method of claim 11 wherein the signal analysis technique is cross correlation.

* * * * *